US006096485A

United States Patent [19]

Kasai et al.

[11] Patent Number: 6,096,485

[45] Date of Patent: Aug. 1, 2000

[54] DESENSITIZING SOLUTION FOR LITHOGRAPHIC PRINTING

[75] Inventors: Seishi Kasai; Ryousuke Itakura; Eiichi Kato, all of Shizuoka, Japan

[73] Assignee: Fuji Photo Film Co., Ltd., Kanagawa, Japan

[21] Appl. No.: 09/420,396

[22] Filed: Oct. 18, 1999

[30] Foreign Application Priority Data

Oct. 22, 1998 [JP] Japan ..... 10-301249

[51] Int. Cl.[7] ..... G03C 5/30; G03F 7/32

[52] U.S. Cl. ..... 430/331; 430/444

[58] Field of Search ..... 430/331, 444

[56] References Cited

U.S. PATENT DOCUMENTS 5,723,239 3/1998 Itakura et al. ..... 430/49

5,730,787 3/1998 Kasai et al. ..... 106/2

5,965,660 10/1999 Kasai et al. ..... 524/547

*Primary Examiner*—Hoa Van Le

*Attorney, Agent, or Firm*—McAulay Nissen; Goldberg & Kiel, LLP

[57] ABSTRACT

A desensitizing solution for lithographic printing is disclosed, which comprises at least one organometallic polymer containing at least two partial structure units represented by the following formula (1):

(1)

wherein $R^0$ represents $—PO_3H_2$, $—OPO_3H_2$ or a salt thereof.

6 Claims, No Drawings

DESENSITIZING SOLUTION FOR LITHOGRAPHIC PRINTING

FIELD OF THE INVENTION

The present invention relates to a desensitizing solution for lithographic printing and, more particularly, to a desensitizing (process) solution used for a lithographic printing plate precursor comprising a metal oxide or sulfide and a binding resin such as an electrophotographic printing plate precursor or a direct-drawing type printing plate precursor.

BACKGROUND OF THE INVENTION

Examples of a lithographic printing plate precursor which is employed at present chiefly in the field of the small-scale commercial printing include (1) a direct-drawing type printing plate precursor comprising a hydrophilic image receiving layer provided on a water resisting support, (2) a printing plate precursor comprising a zinc oxide-containing image receiving layer (ink receptive layer =lipophilic layer) provided on a water resisting support, which is made into a printing plate by drawing images directly thereon by means of, e.g., a thermal printer, a dry laser printer or an ink jet printer and then processing the non-image area with a desensitizing solution, (3) an electrophotographic material comprising a zinc oxide-containing photoconductive layer provided on a water resisting support, which functions as a printing plate precursor to be made into a printing plate by forming images on the photoconductive layer in an electrophotographic process and then processing the non-image area with a desensitizing solution, and (4) a silver halide photographic material functioning as a printing plate precursor, which comprises a silver halide emulsion layer provided on a water resisting support.

In general the printing plate constituted of a water-wettable non-drawing area (water receptive area= hydrophilic area) and a water-unwettable drawing area (ink receptive area=lipophilic area) is used for lithography. However, the lithographic printing plate precursors (2) and (3) are each provided with a ZnO-containing hydrophobic layer. As far as the printing operation is carried out without giving any processing to the printing precursors after image formation, the printing ink adheres to the non-drawing area also to make normal printing impossible.

Therefore, it is necessary to desensitize the non-drawing area of the printing plate precursor prior to the printing operation, and thereby confer the water wettability thereon. The desensitizing solutions which have so far been proposed for such a purpose comprise cyanide-containing (process) solutions containing as the main component ferrocyanide or ferricyanide, and cyanide-free (process) solutions containing as their main component an ammine-cobalt complex, phytic acid (inositol hexaphosphate) or a derivative thereof, or a guanidine derivative.

However, those processing solutions are not wholly satisfactory. More specifically, the ferrocyanide or ferricyanide-containing process solutions, though they have advantages of high desensitizing power, water-receptive firm film formability and high film-forming speed, have also disadvantages that, when exposed to light, they are colored and deposit precipitates due to lability of ferrocyanide and ferricyanide ions to heat and light, thereby undergoing a drop in desensitizing power, and further cause various problems regarding environmental pollution, including disposal of waste solutions, because the cyanide ions ($CN^-$) contained therein are detected as free cyanogen.

From consideration of those disadvantages, the latter cyanide-free processing solutions have been proposed, wherein the desensitizer such as an ammine-cobalt complex, phytic acid or a guanidine compound is contained as a main component. However, even these solutions are not wholly satisfactory as a desensitizing (process) solution applied to lithographic printing plate precursors. This is because they are slow in film-forming speed, as compared with the former cyanide-containing process solutions, and have a defect that they cannot form a water receptive film having high enough physical strength to withstand printing operations at the first etching system using a processor, thereby causing generation of background stain and plugging in dot gradation.

As is generally known, phytic acid and its metal derivatives form metal chelate compounds. Many compounds of such a kind have already been offered as desensitizers for offset printing plate precursors. However, they are each slow in film-forming speed and cannot form a water-receptive film applicable to printing at the first time of processing with a processor. Therefore, they have drawbacks of occurring poor ink separability, background stain and plugging in dot gradation.

In order to overcome such drawbacks, the addition of various additives to the processing solutions containing phytic acid compounds has been examined.

For instance, the combined use of phytic acid compounds and the metal complexes of aminocarboxylic acids (JP-B-2-39397, the term "JP-B" as used herein means an "examined Japanese patent publication"), the combined use of phytic acid compounds and the hexametaphosphates (JP-B-62-7597), and the addition of lower amines, alkanolamines or polyamines to the processing solutions of the foregoing type (e.g., JP-A-54-117201, JP-A-53-109701 and JP-A-1-25994; the term "JP-A" as used herein means an "unexamined published Japanese patent application") were considered. However, those processing solutions have two problems; one problem is in that, although they can provide good water receptivity in the early stage of use, their etching ability is lowered by continuous use to bring about a decline in water receptivity, and the other problem is in that their use after long-term storage causes deterioration in water receptivity to generate background stain.

The addition of cationic polymers to the processing solutions containing phytic acid compounds (JP-A-50-23099) produces, similarly to the addition of the foregoing additives, deterioration in properties of the processing solutions by the continuous use or long-term storage, and causes rust in some cases.

Further, the combined use of phytic acid compounds with the polyethyleneimine copolymers has been proposed (JP-A-7-68967 and JP-A-7-137475). However, it allows the processing solutions only a narrow latitude in the matter of compatibility of the etching ability for making the non-image area receptive of water with the ink receptivity of the image area, or cannot dissolve the problem of causing deterioration in properties by long-term continuous use.

In recent years, on the other hand, automatic printing machines, particularly miniaturized ones, of the type which incorporate a desensitizing system into the body thereof from the viewpoint of saving labor have been remarkably popularized, and the plate making of an offset master by electrophotographic system has enabled a reduction of processing time. Such a situation has been demanding a reduction in desensitizing time and an extension of the life span of a desensitizing solution.

Further, it has been proposed to adopt a digital exposure method in the electrophotographic system master making system also. Such an exposure method has enabled easy making of masters having high-definition images, such as middle tone and screen tint, in addition to conventional plate-making images constituted mainly of line original and letter original. As a result, it has been demanding to make a printing plate enabling the reproduction of such high-definition images on printing materials in a printing process. On the other hand, thermal and dry laser printers have made it possible to confer high definition on plate-making images and reduce background stains on non-image areas, and thereby a demand for making a printing plate from a printing plate precursor of direct-drawing type by prepress processing has been generated. However, it is difficult with conventional desensitizing solutions to meet the foregoing demands.

SUMMARY OF THE INVENTION

One object of the invention is therefore to provide a desensitizing (process) solution for lithographic printing, which not only has excellent desensitizing performance but also causes no pollution problem, shows good stability upon long-term storage and continuous use, and further enables a reduction of etch-processing time.

Another object of the present invention is to provide a desensitizing (process) solution for lithographic printing, which enables the making of a lithographic printing plate having good reproducibility of high-definition images, such as middle tone and screen tint, and developing no background stain on the non-image areas during the course of printing.

It has been found that the aforementioned objects can be attained when the processing solutions according to the following Embodiments 1 to 6 are each used for etching a lithographic printing plate precursor:

1. A desensitizing solution for lithographic printing, comprising at least one organometallic polymer containing at least two partial structure units represented by the following formula (1):

(1)

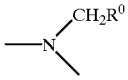

wherein $R^0$ represents $—PO_3H_2$, $—OPO_3H_2$ or a salt thereof.

Preferred embodiments are show below.

2. The desensitizing solution as described in Embodiment 1, wherein the organometallic polymer is a polymer prepared by hydrolytic polycondensation of at least one organometallic compound represented by the following formula (2):

$$(Q)_rM(Y)_{p-r} \quad (2)$$

wherein Q represents an organic residue having a partial structure unit represented by formula (1), Y represents a reactive group, M represents from trivalent to hexavalent metal, p represents the valence number of the metal M, and r represents 1, 2, 3, or 4, provided that p-r is 2 or more.

3. The desensitizing solution as described in Embodiment 1, wherein the organometallic polymer is a copolymer comprising at least one unit selected from the group consisting of the units represented by the following formulae (3) to (8):

(3)

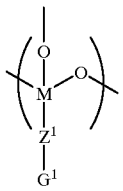

(4)

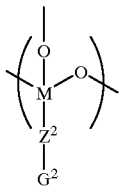

(5)

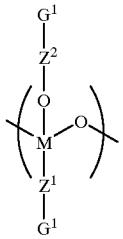

(6)

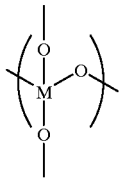

(7)

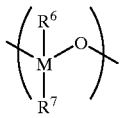

(8)

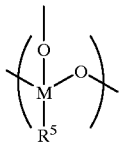

wherein $G^1$ represents $—N(R^1)CH_2R^0$ or $—N(CH_2R^0)_2$; $R^0$ has the same meaning as in formula (1); $G^2$ represents $—NR^2R^3$ or $—NR^2R^3R^{4+}X^-$; each of $R^1$ to $R^7$ represents a hydrogen atom or an unsubstituted or substituted organic residue, and they may combine each other to form a ring; $X^-$ represents a monovalent or higher valent anion; $Z^1$ and $Z^2$ which may be the same or different, each represent a divalent organic residue; and M has the same meaning as in formula (2).

4. The desensitizing solution as described in any of Embodiments 1, 2 and 3, wherein the organometallic polymer is a polymer constituted of organometallic polymers cross-linked between their main chains.

5. The desensitizing solution as described in Embodiment 3, wherein the metal M in formulae (3) to (8) is Si.

6. The desensitizing solution as described in Embodiment 1, wherein the organometallic polymer is a polymer represented by the following formula (9):

(9)

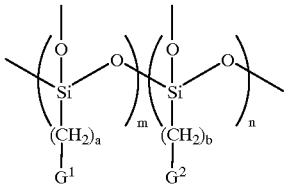

wherein $G^1$ and $G^2$ have the same meanings as $G^1$ and $G^2$ respectively in formulae (3) to (8); a and b each represent an integer of from 1 to 10; and m and n are values the total of which is 100 weight %.

DETAILED DESCRIPTION OF THE INVENTION

The present organometallic polymer having at least two partial structure units represented by formula (1) has an extreme improvement in chelating reactivity and precipitate forming speed on account of characteristics of its chemical structure, as compared with hitherto known compounds having chelating ability, such as phytic acid and phytic acid salts. It is therefore presumed that the present organometallic polymer can improve water-receptivity providing speed and reduce the processing time for desensitization. Thus, the total duration of printing plate precursors' stay in the desensitizing solution becomes short, as compared with those in conventional desensitizing solutions, even if the same number of printing plate precursors are processed continuously. Further, the organometallic polymer can control contamination by $Zn^{2+}$ and like ions which bring about precipitates in the desensitizing solution. As a result, the desensitizing solution of the present invention can have not only high desensitizing ability but also improved aging stability and running properties.

The desensitizing solution of the present invention contains neither ferrocyanide compounds nor ferricyanide compounds causing environmental pollution and suffering deterioration when exposed to light or heat, and further it is little affected by platemaking environment, as compared with conventional cyanide-free processing solutions. In addition, the desensitizing solution of the present invention is stable upon long-term storage to cause neither change of color nor precipitation and has markedly improved film-forming speed, so that even in the case of high-speed etching treatment, though free of cyanides, it enables to make lithographic printing plates developing neither background stain nor plugging of dot gradation.

$R^0$ in formula (1) represents a phosphonic acid group ($—PO_3H_2$), a phosphoric acid group ($—OPO_3H_2$), or a salt thereof. Suitable examples of such a salt include the inorganic salts of alkalis (e.g., lithium, sodium, potassium), the ammonium salts, the salts of organic bases [e.g., primary, secondary or tertiary amines (containing hydrocarbon group (s), such as methyl, ethyl, propyl, butyl, pentyl, hexyl, heptyl, octyl, decyl, dodecyl, tridecyl, tetradecyl, hexadecyl, octadecyl, cyclohexyl, cyclooctyl, benzyl or/and phenetyl groups, in which each may have substituent(s) such as hydroxyl, halogen, cyano, alkoxy or/and amido), anilines (e.g., aniline, N-methylaniline, N,N-dimethylaniline, N-ethylaniline, N-butylaniline, N-methyl-N-butylaniline) and hetero atom-containing cyclic nitrogen compounds (e.g., pyridine, morpholine, piperazine)], or the inner salts formed of the acid groups and $=NCH_2—$ (e.g., $=^+N(H)CH_2PO_3H^-$, $=^+N(H)CH_2OPO_3H^-$). A part or all of the acid groups in the molecule may be a salt, and the salts formed may be the same or different.

The organometallic polymer of the present invention is a polymer having at least two partial structure units (chelating groups) represented by formula (1). In particular, it is desirable for the polymer to contain a combined total of at least 4 phosphonic and/or phosphoric acid groups so as to have a steric configuration enabling the stable complex structure of metal ions having a coordination number of 4, such as $Zn^{2+}$ ion. Further, it is desirable for the organometallic polymer of the present invention to have each of the chelating groups of formula (1) via a hydrocarbon group having 1 to 6 carbon atoms.

Furthermore, it is preferred in the present invention that the organometallic polymer be a polymer synthesized by hydrolytic polycondensation of at least one compound selected from the organometallic compounds represented by formula (2). As an example of hydrolytic polycondensation carried out for the polymer synthesis, a reaction that the compound molecules undergoes condensation repeatedly via the hydrolysis of their reactive groups Y to be polymerized is exemplified. In the representative reaction, alkoxysilyl groups undergoes dealcoholization in the presence of an acid or a base and condensed repeatedly to form a polymer.

Suitable examples of a reactive group Y in formula (2) include a hydroxyl group, a halogen atom (e.g., fluorine, chlorine, bromine and iodine atoms), or a group of formula $—OR^8$, $—OCOR^9$, $—CH(COR^{10})(COR^{11})$, $—CH(COR^{10})(COOR^{11})$ or $—N(R^{12})(R^{13})$.

$R^8$ in the group $—OR^8$ represents an unsubstituted or substituted aliphatic group containing 1 to 10 carbon atoms (e.g., methyl, ethyl, propyl, butyl, pentyl, hexyl, heptyl, octyl, nonyl, decyl, propenyl, butenyl, hexenyl, heptenyl, octenyl, decenyl, 2-hydroxyethyl, 2-hydroxypropyl, 2-methoxyethyl, 2-(methoxyethyloxo)ethyl, 2-(N,N-diethylamino)ethyl, 2-methoxypropyl, 2-cyanoethyl, 3-methyloxapropyl, 2-chloroethyl, cyclohexyl, cyclopentyl, cyclooctyl, chlorocyclohexyl, methoxycyclohexyl, benzyl, phenetyl, dimethoxybenzyl, methylbenzyl, bromobenzyl).

$R^9$ in the group $—OCOR^9$ represents the same aliphatic group as described above for $R^8$, or an unsubstituted or substituted aromatic group having 6 to 12 carbon atoms (e.g., phenyl, tolyl, xylyl, methoxyphenyl, chlorophenyl, carboxyphenyl, diethoxyphenyl, naphthyl).

In the groups $—CH(COR^{10})(COR^{11})$ and $—CH(COR^{10})(COOR^{11})$, $R^{10}$ represents an alkyl group having 1 to 4 carbon atoms (e.g., methyl, ethyl, propyl, butyl) or an aryl group (e.g., phenyl, tolyl, xylyl), and $R^{11}$ represents an alkyl group having 1 to 6 carbon atoms (e.g., methyl, ethyl, propyl, butyl, pentyl, hexyl), an aralkyl group containing 7 to 12 carbon atoms (e.g., benzyl, phenetyl, phenylpropyl, methylbenzyl, methoxybenzyl, carboxybenzyl, chlorobenzyl) or an aryl group (e.g., phenyl, tolyl, xylyl, mesityl, methoxyphenyl, chlorophenyl, carboxyphenyl, diethoxyphenyl)

$R^{12}$ and $R^{13}$ in the group $—N(R^{12})(R^{13})$ may be the same or different, and each of them represents a hydrogen atom or an unsubstituted or substituted aliphatic group having 1 to 10 carbon atoms (including the same groups as described above for $R^8$ in the group $—OR^8$).

It is preferable that the total of carbon atoms of $R^{10}$ and $R^{11}$ and the total of carbon atoms of $R^{12}$ and $R^{13}$ each is 12 or less.

Suitable examples of the metal M include transition metals, rare earth metals and metals of Groups III to V, preferably Al. Si, Sn, Ge, Ti, Zr and W, more preferably Al, Si, Sn, Ti and Zr, particularly preferably Si.

Preferably, the organometallic polymer of the present invention is a polymer containing at least one unit selected from the units represented by formulae (3) to (8) (hereinafter referred to as "Polymer (A)"). In particular, at least either units which are represented by formula (3) or units which are represented by formula (5) are preferred as copolymerizing units of Polymer (A), and such units can be contained in Polymer (A) in combination with at least one unit selected from the units represented by formulae (4), (6), (7) and (8). Moreover, it is particularly preferred for the present invention that the organometallic polymer be a polymer represented by formula (9) (hereinafter referred to as "Polymer (C)").

$R^1$ to $R^7$ in formulae (3) to (8) each represents a hydrogen atom or an unsubstituted or substituted organic residue, or these groups may combine each other to form rings. Examples of such an organic residue include an unsubstituted or substituted alkyl group having 1 to 18 carbon atoms, a cycloalkyl group, an alkenyl group, an aralkyl group, an aryl group, an alkoxy group, a sulfido group, an amino group, a halogen atom, a cyano group, a nitro group, a hydroxyl group, a carboxyl group, a phosphnic acid group, a phosphoric acid group, a sulfonic acid group (the acid groups described above include salts thereof), an amido group, a sulfonamido group, an ester group, an urea group and an urethane group. Examples of a substituent group for the organic residue include an alkoxy group, a sulfido group, an amino group, a halogen atom, a cyano group, a nitro group, a hydroxyl group, a carboxyl group, a phosphonic acid group, a phosphoric acid group, a sulfonic acid group (the acid groups described above include salts thereof), an amido group, a sulfonamido group, an ester group, an urea group and an urethane group.

Further, $R^1$ to $R^7$ may combine each other to form an unsubstituted or substituted alicyclic or aromatic ring having 3 to 22 carbon atoms.

Preferably, $R^1$ to $R^7$ each represent a hydrogen atom, an unsubstituted or substituted alkyl group having 1 to 14 carbon atoms (e.g., methyl, ethyl, propyl, isopropyl, butyl, isobutyl, hexyl, heptyl, octyl, decyl, dodecyl, hexadecyl, octadecyl, 2-hydroxyethyl, 2-hydroxypropyl, 3-hydroxypropyl, 4-hydroxybutyl, 2-hydroxybutyl, 2-methoxyethyl, 2-botoxyethyl, 2-ethoxyethyl, 4-methoxybutyl, methylthioethyl, methylthiobutyl, 2-aminoethyl, N,N'-dimethylaminoethyl, piperizinomethyl, pyrrolidinoethyl, 2-chloroethyl, 2-chlorobutyl, 2-bromoethyl, 2-cyanoethyl, 4-cyanobutyl, 2-carboxyethyl, carboxymethyl, 3-carboxypropyl, 3-morpholinopropyl, 2-morpholinoethyl, 2-sulfoethyl, 2-piperizinoethyl, amidomethyl, thioethyl, imidazolidinoethyl, sulfonamidoethyl, phosphonopropyl, phosphonometnylaminoethyl), an unsubstituted or substituted alkenyl group having 2 to 18 carbon atoms (e.g., vinyl, allyl, isopropenyl, butenyl, hexenyl, heptenyl, octenyl), an unsubstituted or substituted aralkyl group (e.g., benzyl, phenetyl, naphthylmethyl, 2-naphthylethyl, methoxybenzyl, ethoxybenzyl, methylbenzyl), an unsubstituted or substituted cycloalkyl group having 5 to 8 carbon atoms (e.g., cyclopentyl, cyclohexyl, cycloheptyl) or an unsubstituted or substituted aryl group having 6 to 12 carbon atoms (e.g., phenyl, tolyl, xylyl, mesityl, naphthyl, methoxyphenyl, ethoxyphenyl, fluorophenyl, methyl-chlorophenyl, difluorophenyl, bromophenyl, chlorophenyl, dichlorophenyl, methyl-carbonylphenyl, methoxycarbonylphenyl, ethoxycarbonylphenyl, methanesulfonylphenyl, cyanophenyl).

Further, $R^1$ to $R^7$ may combine each other to form a ring. Suitable examples of a ring formed include unsubstituted or substituted aliphatic rings having 3 to 18 carbon atoms (e.g., cyclopropane, cyclobutane, cyclopentane, cyclohexane, cycloheptane, bicyclo[2,2,1]heptene, bicyclo[2,2,2]octane) and unsubstituted or substituted aromatic rings having 3 to 14 carbon atoms (e.g., benzene, naphthalene, anthracene, pyrrole, pyridine, imidazole, thiophene). Examples of a substituent group for a ring include the same substituent groups as described above for $R^1$ to $R^7$.

The linkage groups $Z^1$ and $Z^2$ in formulae (3) to (5) may be the same or different. Preferably, $Z^1$ and $Z^2$ each represents a divalent aliphatic or aromatic group. Examples of such an aliphatic group include $—(CH_2)_{ml}—$ (wherein ml is an integer of 2 to 18), $—CH_2—C(g^1)(g^2)—$ (wherein $g^1$ and $g^2$ each represent a hydrogen atom or an alkyl group having from 1 to 12 carbon atoms, such as methyl, ethyl, propyl, butyl, hexyl, octyl, decyl or dodecyl, provided that it is excluded that both of $g^1$ and $g^2$ are hydrogen atoms) and $—CH(g^3)—(CH2)_{m2}—$ (wherein $g^3$ represents an alkyl group having from 1 to 12 carbon atoms, such as methyl, ethyl, propyl, butyl, hexyl or octyl, and m2 is an integer of 2 to 18), which each may contain —O—, —S—, $—N(k^1)—$, —SO—, $—SO_2—$, —COO—, —OCO—, —CONHCO—, —NHCONH—, $—CON(k^1)—$, $—SO_2N(k^1)—$ or/and $—Si(k^1)(k^2)—$ (wherein $k^1$ and $k^2$ are each a hydrogen atom, an alkyl group having from 1 to 12 carbon atom such as methyl, ethyl, propyl, butyl, hexyl, octyl, decyl, dodecyl, 2-methoxyethyl, 2-chloroethyl or 2-cyanoethyl, an aralkyl group such as benzyl, methylbenzyl, chlorobenzyl, methoxybenzyl or phenetyl, or an aryl group such as phenyl, tolyl, chlorophenyl, methoxyphenyl or butylphenyl).

Examples of such a divalent aromatic group include divalent groups derived from a benzene ring, a naphthalene ring and a 5- or 6-membered heterocyclic ring (containing at least one oxygen, sulfur or nitrogen atom as ring-constituting hetero atom). These aromatic rings each may have a substituent, and examples of such a substituent include a halogen atom (such as fluorine, chlorine, bromine), an alkyl group having from 1 to 8 carbon atoms (e.g., methyl, ethyl, propyl, butyl, hexyl, octyl) and an alkoxy group having from 1 to 6 carbon atoms (e.g., methoxy, ethoxy, propoxy, butoxy).

Examples of such a heterocyclic ring include furan, thiophene, pyridine, pyrazine, piperazine, tetrahydrofuran, pyrrole, tetrahydropyran and 1,3-oxazoline rings.

$G^1$ in formulae (3) and (5) represents $—N(R^1)CH_2R^0$ or $—N(CH_2R^0)_2$ wherein $R^0$ and $R^1$ have the same meanings as described hereinbefore respectively. Further, $R^1$ may contain $—N(R^1)CH_2R^0$ or $—N(CH_2R^0)_2$.

$G^2$in formula (4) represents $—NR^2R^3$ or $—NR^2R^3R^4X^-$ wherein $X^-$ is preferably a monovalent to trivalent anion, with examples including inorganic electrolytes, such as $Cl^-$, $Br^-$,$I^-$, $F^-$, $H_2PO_4^-$, $PO_4^{3-}$, $H_2PO_3^-$, $HPO_3^{2-}$, $ClO_4^-$, $NO_3^-$, $BF_4^-$, $ClO_3^-$, $PO_3^{3-}$, $HSO_4^-$, $SO_4^{2-}$, $HCO_3^-$, $CO_3^{2-}$ and $PF_6^-$, and organic electrolytes, such as $PhSO_4^-$ (wherein Ph represents phenyl), $CH_3SO_4^-$, $CH_3COO^-$, $CF_3COO^-$, $PhCOO^-$, $^-OOCCOO^-$, $^-OOCCH_2CH_2COO^-$, $^-OOCCH(OH)CH_2COO^-$ and $^-OOCCH(OH)CH(OH)COO^-$.

Specific examples of a polymer containing at least two units selected from units represented by formulae (3) to (8) are illustrated below. The suffixes m, $m_1$, $m_2$, n and l in the structural formula of each exemplified polymer are values the total of which is 100 weight %. However, these examples are not to be construed as limiting the scope of the invention.

1
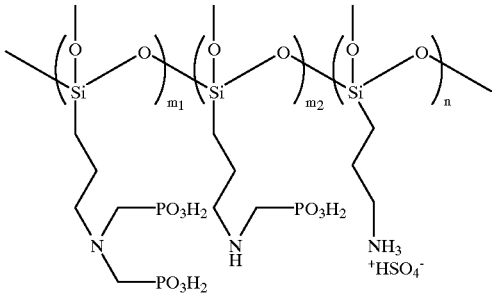
2
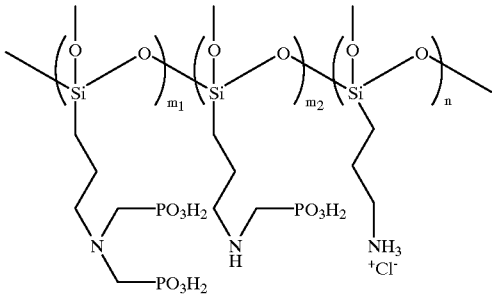
3
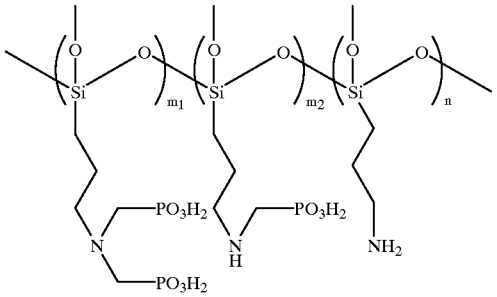
4
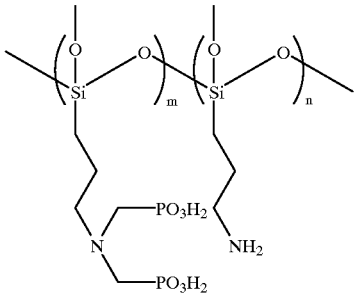
5
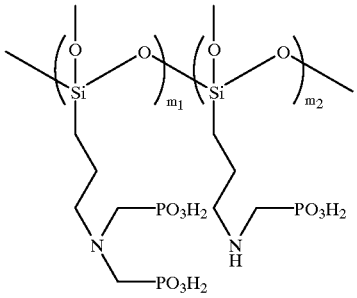
-continued
6
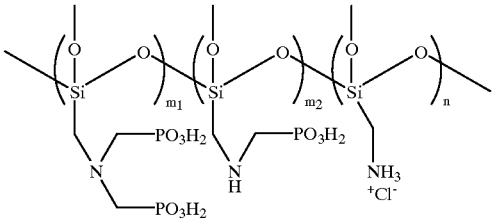
7
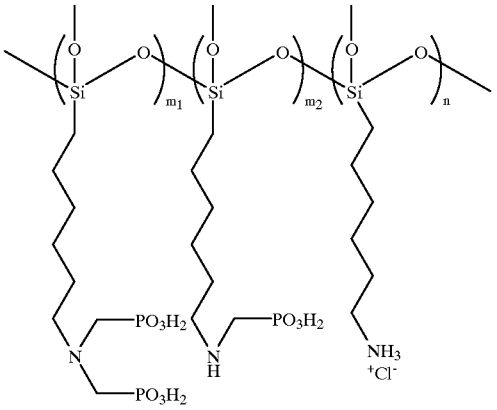
8
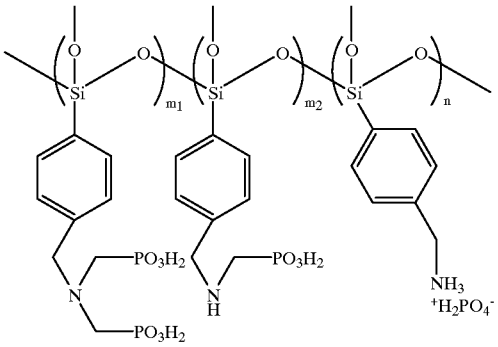
9
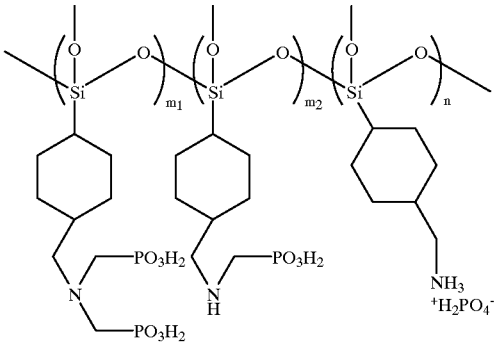

-continued
10
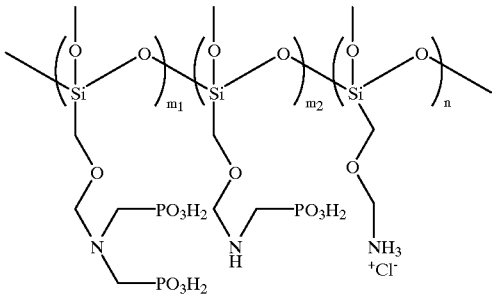
11
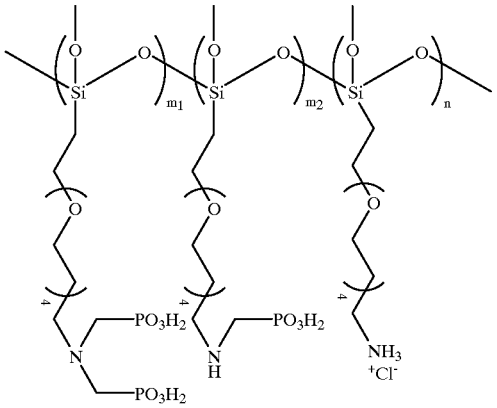
12
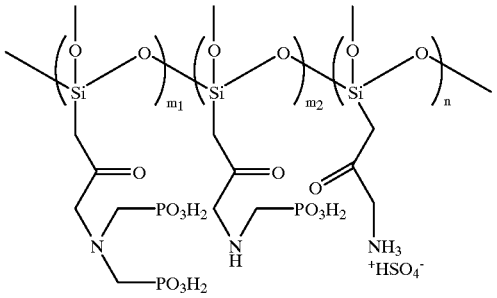
13
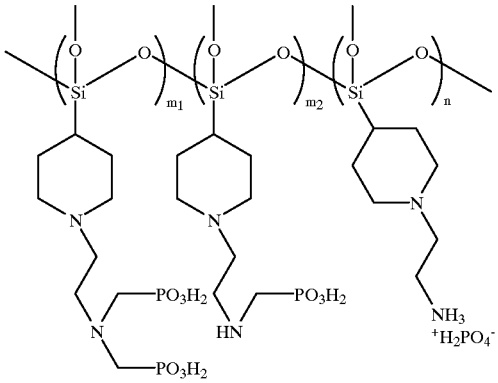
-continued
14
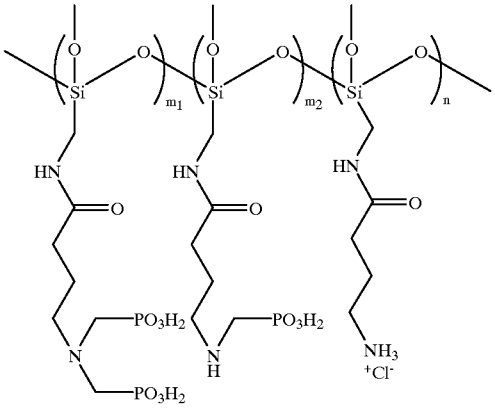
15
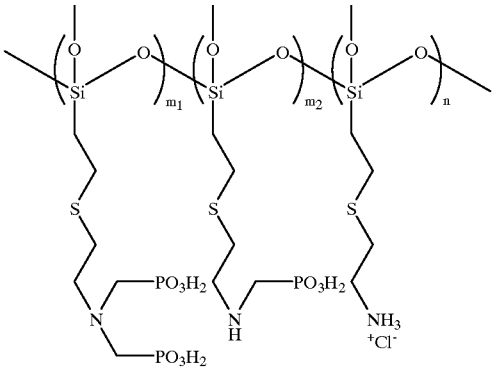
16
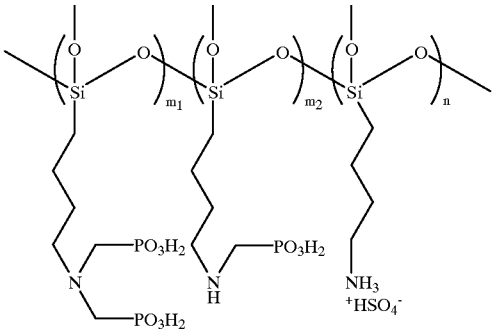
17
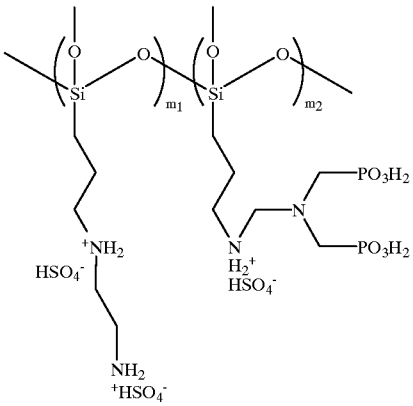

-continued
18
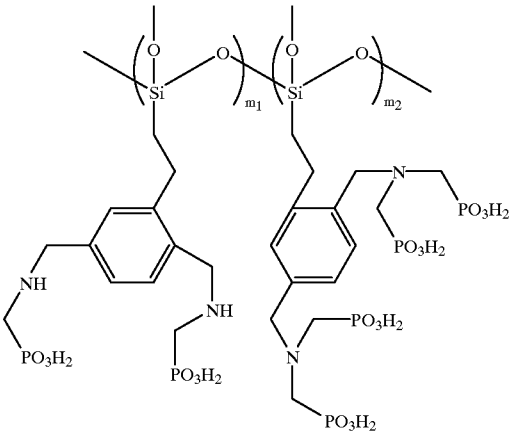
19
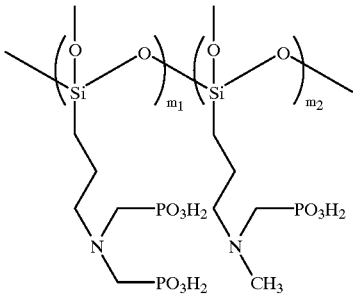
20
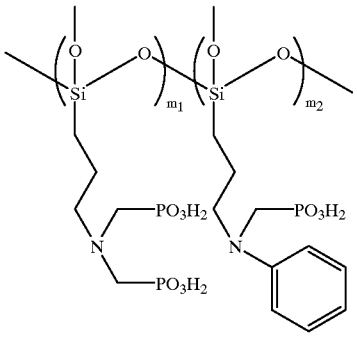
21
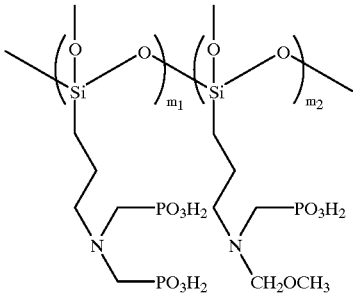
-continued
22
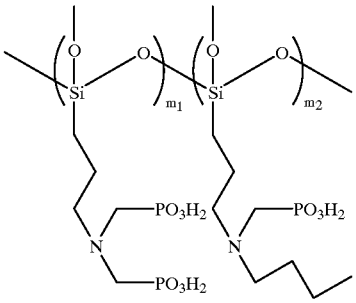
23
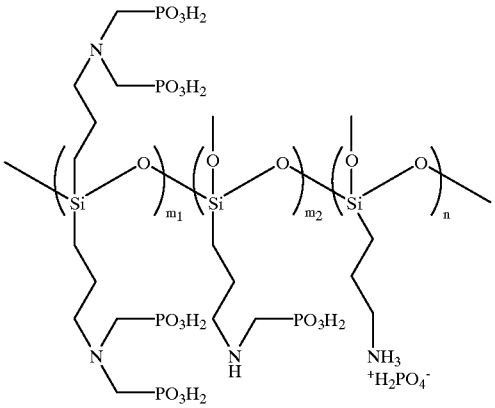
24
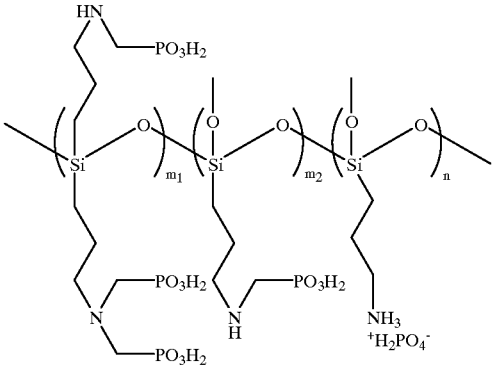
25
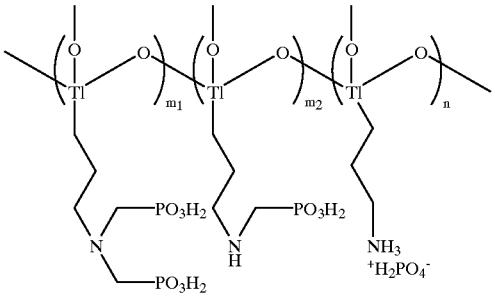

-continued
26
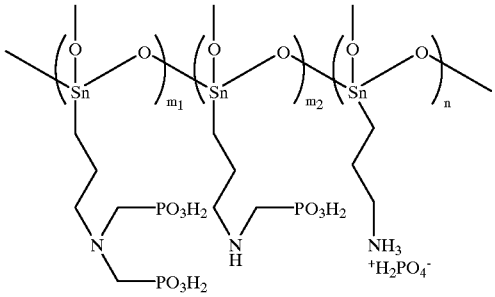
27
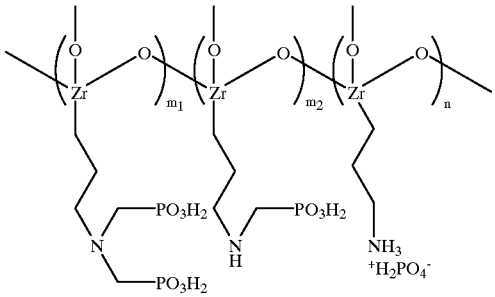
28
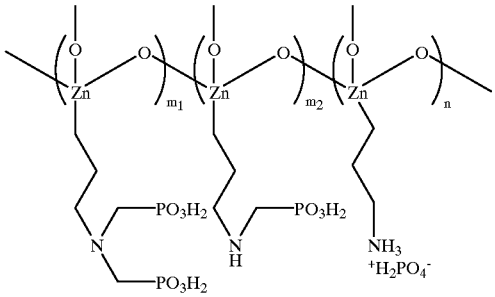
29
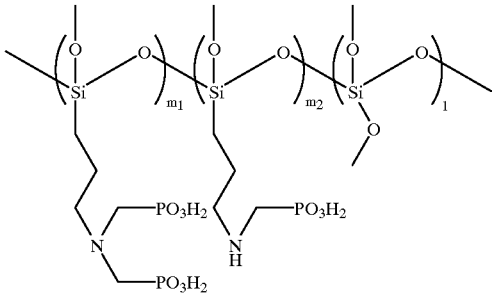
-continued
30
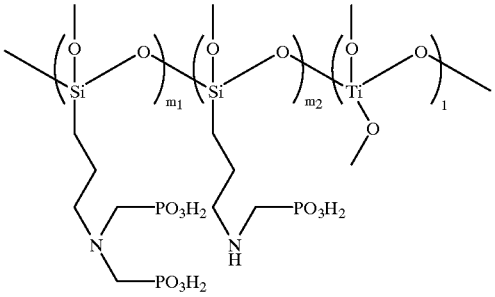
31
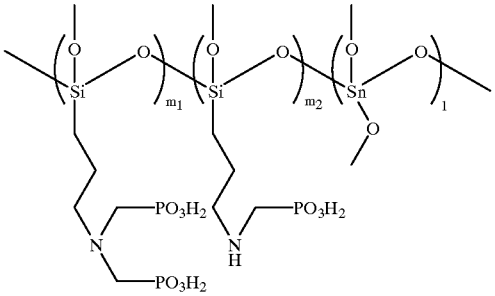
32
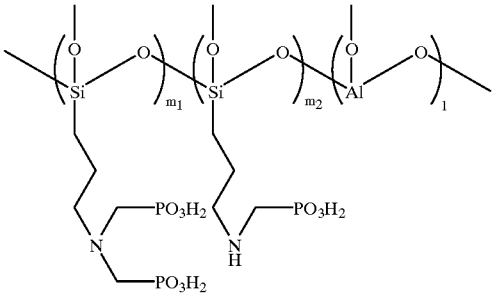
33
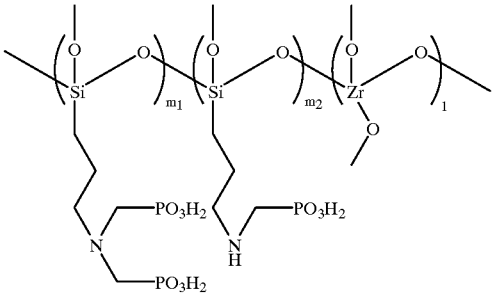

-continued
34
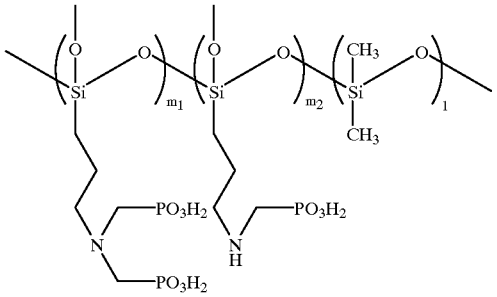
35
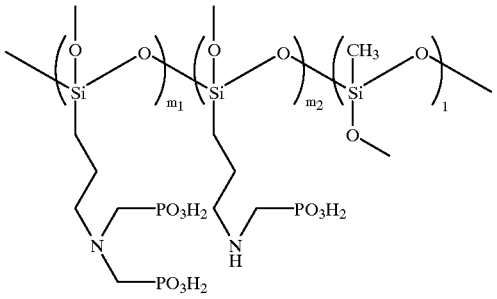
36
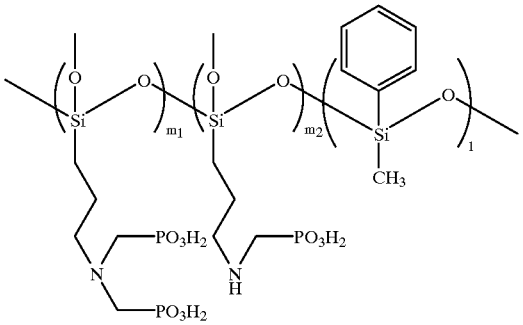
37
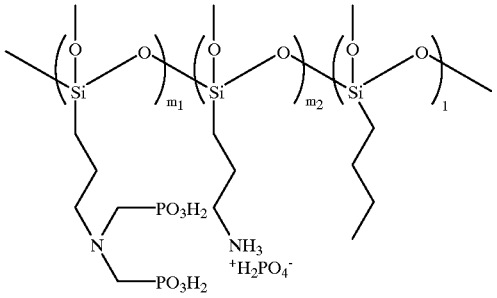
-continued
38
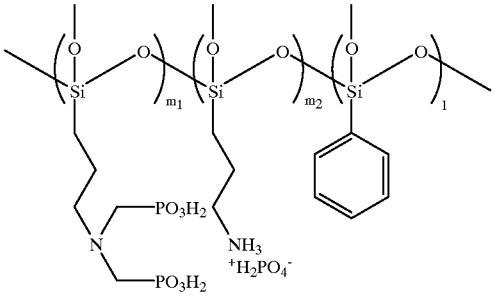
39
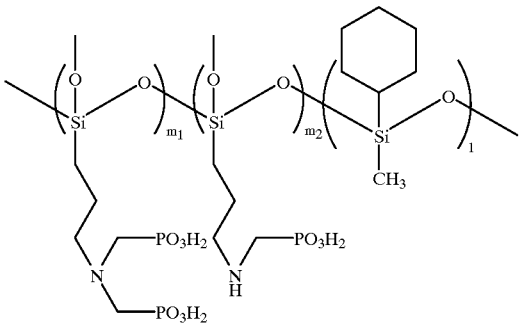
40
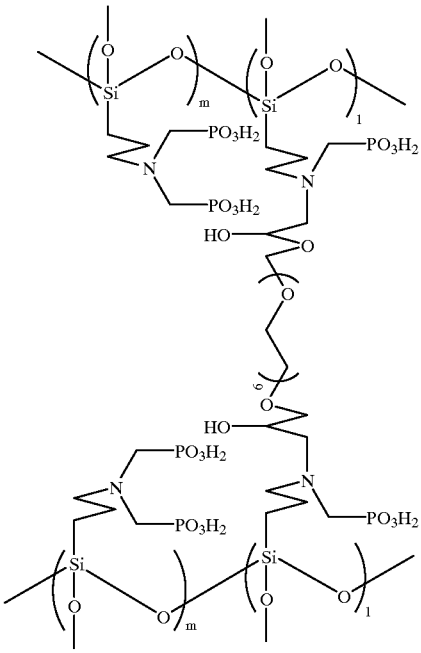

-continued

41

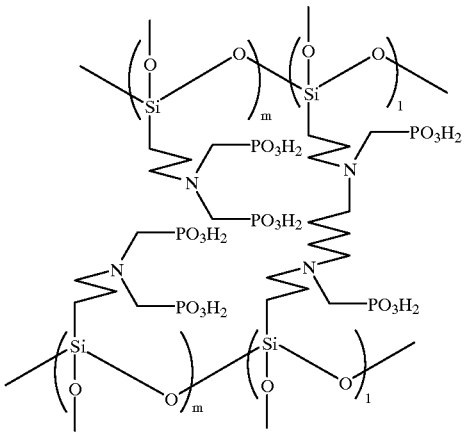

42

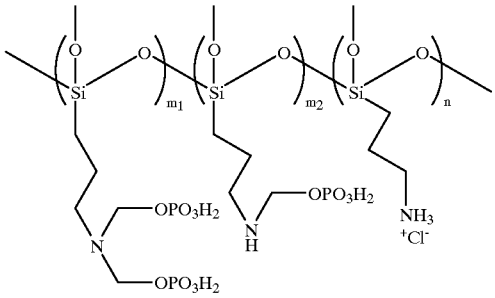

43

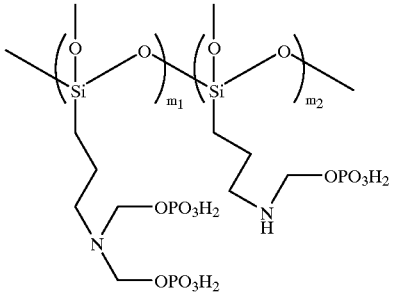

The polymers of the present invention can be synthesized by carrying out the addition reaction of phosphonic acid to a Schiff base, the dehydrating condensation reaction between an alcohol and orthophosphoric acid or the condensation reaction between an alcohol and phosphorus oxychloride, and the sol-gel condensation polymerization of an organometallic compound at the same time, as described in *SYNTHESIS*, pp. 81–96 (1979), and *Jikken Kagaku Koza* 19 (which means "Lectures on Experimental Chemistry", volume 19), published by Maruzen in 1957.

Further, it is desirable for the organometallic polymer used in the present invention to be a polymer wherein the main chains of organometallic polymers according to the present invention are cross-linked to each other (hereinafter referred to as "Polymer B"). The cross-linking reaction between the main chains can be effected by using a compound containing a bifunctional or higher functional group capable of reacting with the amino or hydroxyl groups in the main chains, such as an epoxy, isocyanate or halogenated alkyl group. Examples of such a compound include the compounds described in, e.g., *Kakyozai Handbook* (which means "Handbook of Cross-linking Agents"), compiled by Shinzo Yamashita & Tosuke Kaneko, published by Taisei Co. in 1981.

The suitable weight average molecular weight of an organometallic polymer according to the present invention (including Polymers (A), (B) and (C)) is not higher than $1\times10^5$, preferably not higher than $1\times10^4$.

The weight average molecular weight of each polymer according to the present invention can be determined by the method of utilizing the scattering of light in the aqueous polymer solution (the apparatus usable therefor is, e.g., SLS-600OR manufactured by Otsuka Denshi Co., Ltd.) or the GPC method using water as solvent (the apparatus usable therefor is e.g., S8000 GPC system manufactured by Toso Co., Ltd.).

The organometallic polymers, which constitute the desensitizing (process) solution of the present invention and can chelate zinc ion, are used in an amount of from 10 to 300 parts by weight:, preferably from 20 to 150 parts by weight, per 1,000 parts by weight of the desensitizing solution. These polymers may be used alone or as a mixture of two or more thereof. The desensitizing solution of the present invention can be prepared by dissolving the polymer(s) in ion exchange water or tap water.

Besides the foregoing constituent, the desensitizing (process) solution can contain various additives in appropriate amounts. Examples of such additives include chemical agents for pH adjustment, such as organic and inorganic acids and basic hydroxides, e.g., potassium hydroxide and sodium hydroxide; wetting agents, such as ethylene glycol, sorbitol, glycerin, gum arabic, dipropylene glycol, dimethylacetamide, hexylene glycol, butanediol, butyl cellosolve and surfactants; preservatives, such as salicylic acid, phenol, p-butylbenzoate, sodium dehydroacetate, 4-isothiazoline-3-one compounds, 2-bromo-2-nitro-1,3-propanediol and chloroacetamide; and rust preventives, such as EDTA, pyrophosphoric acid, metaphosphoric acid, hexametaphosphoric acid and 2-mercaptoobenzimidazole. In using the desensitizing (process) solution, it is desirable that the pH thereof be adjusted to the range of 3–6. Additionally, when it is diluted with water, the desensitizing solution can be used as dampening water also.

The present invention will now be illustrated in greater detail by reference to the following examples. However, the invention should not be construed as being limited to these examples.

SYNTHESIS EXAMPLE 1

In a three necked flask, 45 parts by weight of 3-aminopropyltriethoxysilane (produced by Chisso Corporation) dissolved in 80 parts by weight of distilled water and 23 parts by weight of phosphonic acid (produced by Wako Pure Chemical Industries, Ltd.) were placed and stirred for about 20 minutes. Then, the flask was heated in an oil bath, and thereto 10 parts by weight of 36% HCl (produced by Wako Pure Chemical Industries, Ltd.) was added slowly under reflux. Simultaneously therewith, 16.8 parts by weight of a 37% aqueous solution of formaldehyde (produced by Wako Pure Chemical Industries, Ltd.) was added dropwise over a period of about 1 hour. Further, the refluxing was continued for about 5 hours, and then the reaction solution was subjected to spontaneous cooling. The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 1C. The proportions (by weight %) of constitutional units in Polymer 1C were estimated as follows:

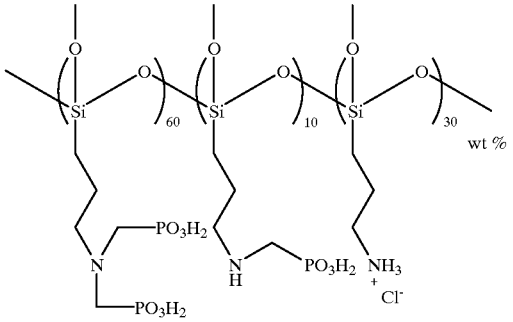

SYNTHESIS EXAMPLE 2

In a three necked flask, 45 parts by weight of 3-aminopropyltriethoxysilane (produced by Chisso Corporation) dissolved in 80 parts by weight of distilled water and 45 parts by weight of phosphonic acid (produced by Wako Pure Chemical Industries, Ltd.) were placed and stirred for about 20 minutes. Then, the flask was heated in an oil bath, and thereto 20 parts by weight of 36% HCl (produced by Wako Pure Chemical Industries, Ltd.) was added slowly under reflux. Simultaneously therewith, 34 parts by weight of a 37% aqueous solution of formaldehyde (produced by Wako Pure Chemical Industries, Ltd.) was added dropwise over a period of about 1 hour. Further, the refluxing was continued for about 5 hours, and then the reaction solution was subjected to spontaneous cooling. The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 2C. The proportions (by weight %) of constitutional units in Polymer 2C were estimated as follows:

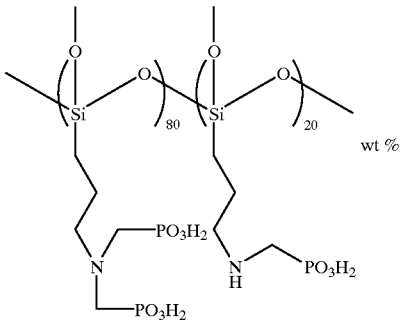

SYNTHESIS EXAMPLE 3

In a three necked flask, 45 parts by weight of 2-(2-aminoethylthio)ethyltrimethoxysilane (produced by Shin-etsu Chemical Industry Co., Ltd.) dissolved in 80 parts by weight of distilled water and 45 parts by weight of phosphonic acid (produced by Wako Pure Chemical Industries, Ltd.) were placed and stirred for about 20 minutes. Then, the flask was heated in an oil bath, and thereto 20 parts by weight of 36% HCl (produced by Wako Pure Chemical Industries, Ltd.) was added slowly under reflux. Simultaneously therewith, 34 parts by weight of a 37% aqueous solution of formaldehyde (produced by Wako Pure Chemical Industries, Ltd.) was added dropwise over a period of about 1 hour. Further, the refluxing was continued for about 5 hours, and then the reaction solution was subjected to spontaneous cooling. The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 1A. The proportions (by weight %) of constitutional units in Polymer 1A were estimated as follows:

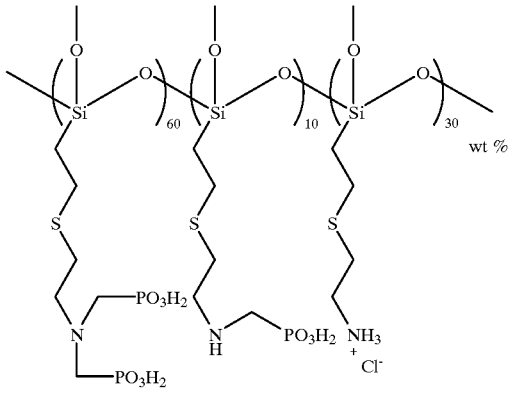

SYNTHESIS EXAMPLE 4

In a three necked flask, a solution containing 32 parts by weight of 3-aminopropyltriethoxysilane (produced by Chisso Corporation) and butyltrimethoxysilane (produced by Shin-etsu Chemical Industry Co., Ltd.) dissolved in 80 parts by weight of distilled water and 45 parts by weight of phosphonic acid (produced by Wako Pure Chemical Industries, Ltd.) were placed and stirred for about 20 minutes. Then, the flask was heated in an oil bath, and thereto 20 parts by weight of 36% HCl (produced by Wako Pure Chemical Industries, Ltd.) was added slowly under reflux. Simultaneously therewith, 34 parts by weight of a 37% aqueous solution of formaldehyde (produced by Wako Pure Chemical Industries, Ltd.) was added dropwise over a period of about 1 hour. Further, the refluxing was continued for about 5 hours, and then the reaction solution was subjected to spontaneous cooling. The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 2A. The proportions (by weight %) of constitutional units in Polymer 2A were estimated as follows:

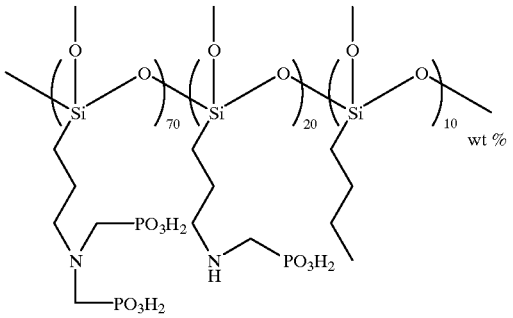

SYNTHESIS EXAMPLE 5

In a three necked flask, 14.2 parts by weight of 3-aminopropyltriethoxysilane (produced by Chisso Corporation) dissolved in 80 parts by weight of distilled water and 62 parts by weight of phosphonic acid (produced by Wako Pure Chemical Industries, Ltd.) were placed and stirred for about 20 minutes. Then, the flask was heated in an oil bath, and thereto 27 parts by weight of 36% HCl (produced by Wako Pure Chemical Industries, Ltd.) was added slowly under reflux. Simultaneously therewith, 21.3 parts by weight of tetramethoxysilane (produced by Tokyo Kasei Co., Ltd. and 1.5 parts by weight of a 37% aqueous solution of formaldehyde (produced by Wako Pure Chemical Industries, Ltd.) each was separately added dropwise over a period of about 1 hour. Further, the refluxing was continued for about 5 hours, and then the reaction solution was subjected to spontaneous cooling. The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 3A. The proportions (by weight %) of constitutional units in Polymer 3A were estimated as follows:

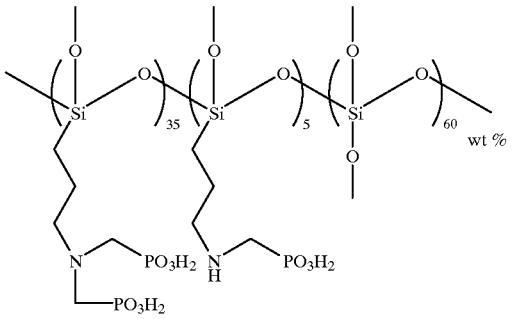

SYNTHESIS EXAMPLE 6

In a three necked flask, 34 parts by weight of 3-aminopropyltriethoxysilane (produced by Chisso Corporation) dissolved in 80 parts by weight of distilled water and 62 parts by weight of phosphonic acid (produced by Wako Pure Chemical Industries, Ltd.) were placed and stirred for about 20 minutes. Then, the flask was heated in an oil bath, and thereto 27 parts by weight of 36% HCl (produced by Wako Pure Chemical Industries, Ltd.) was added slowly under reflux. Simultaneously therewith, 2 parts by weight of tetraethoxytitanium (produced by Tokyo Kasei Co., Ltd.) and 45 parts by weight of a 37% aqueous solution of formaldehyde (produced by Wako Pure Chemical Industries, Ltd.) each was added separately dropwise over a period of about 1 hour. Further, the refluxing was continued for about 5 hours, and then the reaction solution was subjected to spontaneous cooling. The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 4A. The proportions (by weight %) of constitutional units in Polymer 4A were estimated as follows:

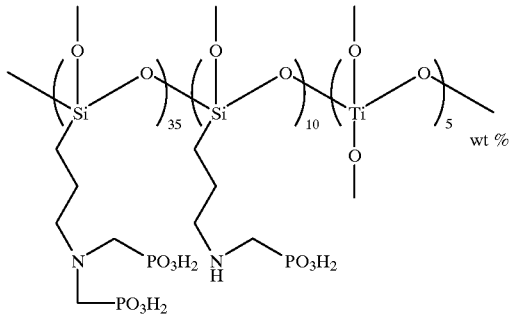

SYNTHESIS EXAMPLE 7

In a three necked flask, 50 parts by weight of 3-aminopropyltriethoxytitanium dissolved in 80 parts by weight of distilled water and 45 parts by weight of phosphonic acid (produced by Wako Pure Chemical Industries, Ltd.) were placed and stirred for about 20 minutes. Then, the flask was heated in an oil bath, and thereto 50 parts by weight of phosphoric acid (produced by Wako Pure Chemical Industries, Ltd.) was added slowly under reflux. Simultaneously therewith, 34 parts by weight of a 37% aqueous solution of formaldehyde (produced by Wako Pure Chemical Industries, Ltd.) was added dropwise over a period of about 1 hour. Further, the refluxing was continued for about 5 hours, and then the reaction solution was subjected to spontaneous cooling.

The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 5A. The proportions (by weight %) of constitutional units in Polymer 5A were estimated as follows:

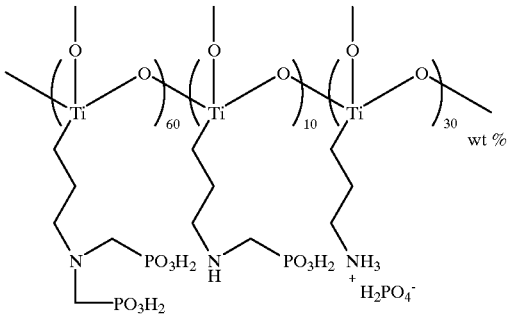

SYNTHESIS EXAMPLE 8

In a three necked flask, 120 parts by weight of distilled water and 45 parts by weight of phosphonic acid (produced by Wako Pure Chemical Industries, Ltd.) were placed and stirred for about 20 minutes. Then, the flask was heated in an oil bath, and thereto 50 parts by weight of phosphoric acid (produced by Wako Pure Chemical Industries, Ltd.) was added slowly under reflux. Simultaneously therewith, 80 parts by weight of 3-aminopropyltributoxytin and 34 parts by weight of a 37% aqueous solution of formaldehyde (produced by Wako Pure Chemical Industries, Ltd.) each was separately added dropwise over a period of about 1 hour. Further, the refluxing was continued for about 5 hours, and then the reaction solution was subjected to spontaneous cooling.

The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 6A. The proportions (by weight %) of constitutional units in Polymer 6A were estimated as follows:

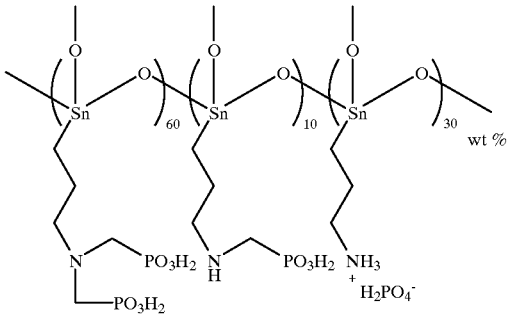

SYNTHESIS EXAMPLE 9

In a three necked flask, a solution containing 2 parts by weight of ethylene glycol diglycidyl ether (400 E, trade name, a product of Kyoeisha Co., Ltd.) and 35 parts by weight of 3-aminopropyltriethoxysilane (produced by Chisso Corporation) dissolved in 80 parts by weight of distilled water and 64 parts by weight of phosphonic acid (produced by Wako Pure Chemical Industries, Ltd.) were placed and stirred for about 20 minutes. Then, the flask was heated in an oil bath, and thereto 28 parts by weight of 36% HCl (produced by Wako Pure Chemical Industries, Ltd.) was added slowly under reflux. Simultaneously therewith, 47 parts by weight of a 37% aqueous solution of formaldehyde (produced by Wako Pure Chemical Industries, Ltd.) was added dropwise over a period of about 1 hour. Further, the refluxing was continued for about 5 hours, and then the reaction solution was subjected to spontaneous cooling. The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 1B. The proportions (by weight %) of constitutional units in Polymer 1B were estimated as follows:

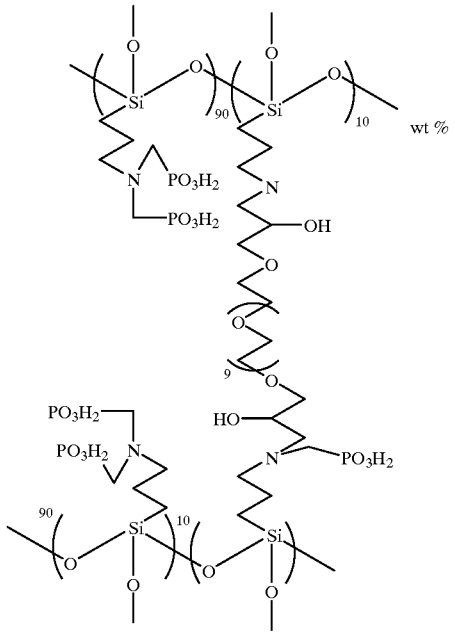

SYNTHESIS EXAMPLE 10

In a three necked flask, 35 parts by weight of 3-aminopropyltriethoxysilane (produced by Chisso Corporation) dissolved in 80 parts by weight of distilled water and 64 parts by weight of phosphonic acid (produced by Wako Pure Chemical Industries, Ltd.) were placed and stirred for about 20 minutes. Thereto, 2 parts by weight of 1,5-dibromopentane (produced by Wako Pure Chemical Industries, Ltd.) was further added dropwise over a period of 30 minutes. Therein, the reaction was run for 30 minutes. Subsequently thereto, the flask was heated in an oil bath, and thereto 28 parts by weight of 36% HCl (produced by Wako Pure Chemical Industries, Ltd.) was added slowly under reflux. Simultaneously therewith, 47 parts by weight of a 37% aqueous solution of formaldehyde (produced by Wako Pure Chemical Industries, Ltd.) was added dropwise over a period of about 1 hour. Further, the refluxing was continued for about 5 hours, and then the reaction solution was subjected to spontaneous cooling. The thus cooled reaction solution was transferred into an eggplant type flask, and most of the water therein was removed. Thereafter, about 5 liter of methanol was poured into the resulting solution to be subjected to crystallization. The thus obtained crystals were filtered off and dried under vacuum to yield the intended Polymer 2B. The proportions (by weight %) of constitutional units in Polymer 2B were estimated as follows:

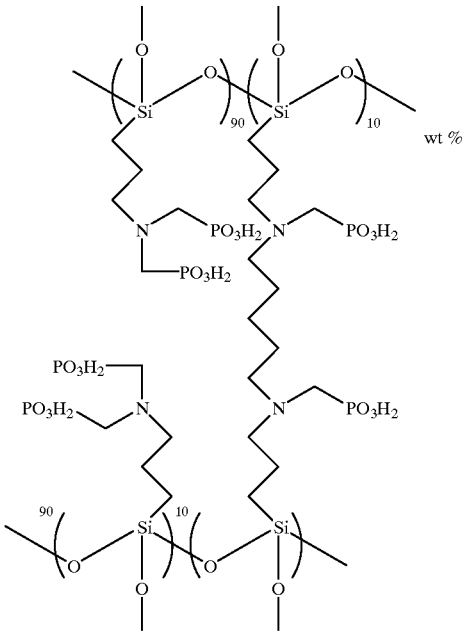

EXAMPLE 1 AND COMPARATIVE EXAMPLES A TO D

[Example 1: Desensitizing Solution E-1]

Water 1,000 parts by weight

Polymer 1C 60 parts by weight

Phosphoric acid 50 parts by weight

The foregoing ingredients were mixed thoroughly to prepare a solution, and the pH of the solution was adjusted to 3.4 by the addition of KOH.

[Comparative Example A: Desensitizing Solution E-a]

Another desensitizing solution was prepared in the same manner as Desensitizing Solution E-1, except that phytic acid was used in the place of Polymer 1C.

[Comparative Example B: Desensitizing Solution E-b]

Still another desensitizing solution was prepared in the same manner as Desensitizing Solution E-1, except that polyvinylsulfonic acid was used in the place of Polymer IC.

[Comparative Example C: Desensitizing Solution E-c]

A further desensitizing solution was prepared in the same manner as Desensitizing Solution E-1, except that the Polymer 1C was replaced by polyallylamine.

[Comparative Example D: Desensitizing Solution E-d]

In addition, a desensitizing solution was prepared in the same manner as Desensitizing Solution E-1, except that the Polymer 1C was replaced by polyethyleneimine.

The evaluation of practical properties in the case of using these desensitizing solutions each is shown in Table 1.

TABLE 1

| Environmental conditions*) | Desensitizing solution No. | Evaluated properties: Background stain I | Background stain II | Ink receptivity I | Ink receptivity II | Running capability | Aging stability |
|---|---|---|---|---|---|---|---|
| Example 1 | E-1 | ○ | ○ | ○ | ○ | ○ good | ○ good |
| Comparative Example A | E-a | Δ | × | Δ | ○ | × deposits accumulated | × background stained |
| Comparative Example B | E-b | × × | × × | ○ | ○ | × × background stained developed | no change occurred |
| Comparative Example C | E-c | × | × | × | Δ | — | — |
| Comparative Example D | E-d | × × | × × | ○ | ○ | — | — |

*) Environmental condition I: 25° C./60% RH.
Environmental condition II: 35° C./80% RH.

The methods adopted for evaluating the properties shown in Table 1 are described below.

1) Background Stain:

The sensitive material ELP-Ix and the totally automatic processor ELP415VX (trade names, products of Fuji Photo Film Co., Ltd.) were allowed to stand for twenty-four hours at ordinary temperature/humidity (20° C./65% RH), and then the platemaking work was carried out using them to form reproduction images. The thus obtained printing plate precursors were each passed once through an etching machine in which any one of the desensitizing solutions prepared in Example 1 and Comparative Examples A to D was placed.

Then, the printing plates obtained were each subjected to printing operations using a printing machine Hamada 611XLA-11 (trade name, manufactured by Hamada Co., Ltd.) and the dampening water prepared by diluting the desensitizing solution of Example 1 five times with distilled water, and each printed matter obtained on the hundredth impression was examined by visual observation for evaluation of background stain.

The evaluation of background stain was carried out with the following four grades.

○: No background stain is observed.

Δ: Background stain is partially observed.

×: Many background stains are observed

××: Many background stains are overall observed.

2) Ink Receptivity:

The printing plate precursors were prepared in the same manners as adopted for the aforementioned background stain evaluation, and they were each passed once through an etching machine in which any one of the desensitizing solutions prepared in Example 1 and Comparative Examples A to D was placed.

Then, the printing plates obtained were each subjected to the same printing operations as performed for the foregoing background stain evaluation, and the screen tint area of each printed matter obtained on the hundredth impression was examined for ink receptivity by visual observation.

The evaluation of ink receptivity was carried out with the following three grades.

○: Failure of ink receptivity is not generated.

Δ: Failure of ink receptivity is slightly generated.

×: Failure of ink receptivity is extremely generated

3) Running capability:

The printing plate precursors were prepared in the same manners as adopted for the aforementioned background stain evaluation, and every 2,000 sheets thereof were each passed once through an etching machine in which any one of the desensitizing solutions prepared in Example 1, Comparative Example A and Comparative Example B was placed.

Then, each printing plate obtained upon two-thousandth passage was subjected to the same printing operations as performed for the foregoing background stain evaluation, and thereby examined for background stain. The condition of each desensitizing solution after passing 2000 sheets of printing plate precursors therethrough was evaluated by the grade of background stain examined above and the quantity of precipitates deposited.

4) Aging stability:

The desensitizing solutions prepared in Example 1 and Comparative Examples A and B were allowed to stand for two weeks under a thermostated condition of 50° C.-80% RH. Thereafter, the printing plate precursors were prepared in the same manners as adopted for the aforementioned background stain evaluation, and they were each passed once through an etching machine in which any one of the desensitizing solutions prepared in Example 1, Comparative Example A and Comparative Example B was placed.

Then, the printing plates obtained were each subjected to the same printing operations as performed for the foregoing background stain evaluation, and thereby examined for background stain. The aging stability was evaluated by the grade of background stain examined above.

As is apparent from the results of Table 1, the desensitizing solution prepared in Example 1 according to the present invention had satisfactory background stain and ensured good ink receptivity. In other words, the properties of the desensitizing solution of the present invention were on a higher level than those of comparative desensitizing solutions prepared in Comparative Examples A to D.

With respect to the running capability, the desensitizing solutions prepared in Comparative Examples A and B brought about precipitates by running use to deteriorate the properties thereof; while the desensitizing solution of the present invention had no precipitates even after continuously passing 2,000 sheets of printing plate precursors therethrough and the initial properties thereof were kept during the continuous use.

In addition, the aging stability of the desensitizing solution of the present invention was good, as compared with those of comparative desensitizing solutions, and the desensitizing solution of the present invention had high keeping quality enough to withstand long-term storage.

As mentioned above, only the desensitizing solution of the present invention withstood a severe environmental condition, continuous use and long-term storage, and caused no background stain.

Additionally, the polyvinylphosphonic acid used in Comparative Example B seems to have a structure similar to those of the polymers of the present invention, and is known as an additive usable for a pH modifier or precipitation inhibitor. However, it hardly functioned as desensitizer. A reason why such an acid was lacking in desensitizing function is presumed to be in that the absence of nitrogen atoms in the acid and small moving freedom of phosphonic acid groups due to their closeness to the polymer main chain make it difficult for the acid to effectively chelate free $Zn^{2+}$ ions.

Further, the polyamines used in Comparative Examples C and D are lacking in ability to chelate free $Zn^{2+}$ ions, and therefore it is difficult to use them as desensitizer.

EXAMPLES 2 AND 3

The printing plate precursors prepared in the following manners were each passed once through an etching machine in which the desensitizing solution E-1 prepared in Example 1 was placed.

Thereafter, the itemized properties were evaluated in the same manner as in Example 1.

[Example 2]

Reproduction images were formed on a direct-drawing lithographic printing plate precursor (AMSIS (trade name) produced by AM Co.) by means of a laser printer (AMSIS•1200-J Plate Setter (trade name)).

[Example 3]

Reproduction images were formed on a direct-drawing lithographic printing plate precursor (AMSIS (trade name), produced by AM Co.) by means of a heat sensitive transfer platemaking machine (Dynic MP1200 Pro (trade name)).

The embodiments of Examples 2 and 3 also achieved satisfactory results in the evaluation of all the itemized properties, including background stain, ink receptivity, tolerance for environmental change, running capability and aging stability, similar to Example 1. EXAMPLES 4 TO 16

Desensitizing solutions were prepared in the same manner as in Example 1, except that the polymers shown in Table 2 were added in their respective amounts shown in Table 2 in place of 60 parts by weight of Polymer 1C, and examined for the same itemized properties as in Example 1.

TABLE 2

| Example No. | Desensitizing solution | Main agent used (Polymer No.) | Amount added (parts by weight) |
|---|---|---|---|
| 4 | E-2 | 1C | 30 |
| 5 | E-3 | 1C | 100 |
| 6 | E-4 | 2C | 60 |
| 7 | E-5 | 2C | 100 |
| 8 | E-6 | 3C | 60 |
| 9 | E-7 | 1A | 60 |
| 10 | E-8 | 2A | 60 |
| 11 | E-9 | 3A | 60 |
| 12 | E-10 | 4A | 60 |
| 13 | E-11 | 5A | 60 |
| 14 | E-12 | 6A | 60 |
| 15 | E-13 | 1B | 60 |
| 16 | E-14 | 2B | 60 |

In the same manner as in Example 1, these desensitizing solutions were each evaluated with respect to all the itemized properties, including background stain, ink receptivity, tolerance for environmental change, running capability and aging stability. The results thereof were satisfactory.

EXAMPLES 7 TO 34

Desensitizing solutions were each prepared in the same manner as in Example 1, except that the Polymer 1C was replaced by a combination of two or more of the polymers of the present invention shown in Table 3. Additionally, the amount of each combination used polymer was fixed at 60 parts by weight. In the same manner as in Example 1, these desensitizing solutions were also examined for background stain, ink receptively, tolerance for environmental change, running capability and aging stability.

TABLE 3

| Example No. | Combination of Polymers [weight %] |
|---|---|
| 17 | 1C/2C = 50/50 |
| 18 | 1C/2C = 75/25 |
| 19 | 1C/2C = 25/75 |
| 20 | 1C/1A = 50/50 |
| 21 | 1C/2A = 50/50 |
| 22 | 2C/3A = 50/50 |
| 23 | 2C/1B = 50/50 |
| 24 | 4A/1B = 50/50 |
| 25 | 5A/2B = 50/50 |
| 26 | 1C/1B/4A/6A = 25/25/25/25 |
| 27 | 1C/1B/3A/5A = 25/25/25/25 |
| 28 | 1B/2B/1A/2A = 25/25/25/25 |
| 29 | 1B/3A/4A/5A = 25/25/25/25 |
| 30 | 2B/2C/5A/6A = 25/25/25/25 |
| 31 | 2B/1A/2A/6A = 40/30/20/10 |
| 32 | 1C/2C/1B/1A = 40/40/10/10 |
| 33 | 1C/2C/2B/3A = 30/30/20/20 |
| 34 | 1A/2A/3A/4A = 30/30/30/10 |

Similarly to Example 1, Examples 17 to 34 also achieved satisfactory results in the evaluation of all the itemized properties, including background stain, ink receptivity, tolerance for environmental change, running capability and aging stability.

EXAMPLES 35 TO 41

Desensitizing solutions were prepared by adding various wetting agents, preservatives and rust preventives shown in Table 4 to the desensitizing solution having the same composition prepared in Example 1, and various properties thereof were evaluated in the same manner as adopted in Example 1.

TABLE 4

| Example No. | Wetting agent | Preservative | Rust preventive |
|---|---|---|---|
| 35 | ethylene glycol | salicylic acid | EDTA |
| 36 | " | " | metaphosphoric acid |
| 37 | " | " | 2-mercapto-benzimidazole |
| 38 | " | sodium dehydroacetate | EDTA |
| 39 | gum arabic | salicylic acid | " |
| 40 | dimethyl-acetamide | " | " |
| 41 | butyl cellosolve | " | " |

Similarly to Example 1, those of Examples 35 to 41 also achieved satisfactory results in the evaluation of all the itemized properties, including background stain, ink receptivity, tolerance for environmental change, running capability and aging stability. In other words, the properties of the desensitizing solution of the present invention were not affected by the addition of various additives.

EXAMPLE 42 AND COMPARATIVE EXAMPLES E AND F

The press life test was carried out using a dampening solution prepared by diluting the desensitizing solution containing the polymer of the present invention or a comparative compound. Additionally, the desensitizing treatment of the printing plate precursor was carried out with the desensitizing solution prepared in Example 1.

[Example 42]

The desensitizing solution of Example 1 was diluted five times with distilled water to prepare a dampening solution.

[Comparative Example E]

The desensitizing solution of Comparative Example A was diluted five times with distilled water to prepare a dampening solution.

[Comparative Example F]

The desensitizing solution of Comparative Example C was diluted five times with distilled water to prepare a dampening solution.

The evaluation results of Example 42 and Comparative Examples E and P are shown in Table 5.

TABLE 5

| Evaluated Item | Example 42 | Comparative Example E | Comparative Example F |
|---|---|---|---|
| Background stain on printed matter | No background stain developed before 5000th impression | Background stain developed upon 2000th impression | Background stain developed upon 1000th impression |

The dampening solution prepared from the desensitizing solution of the present invention was hard to develop background stain, as compared with those of Comparative Examples E and F. Thus, the desensitizing solution of the present invention has proved to be highly effective as a dampening solution.

EFFECT OF THE INVENTION

In accordance with the present invention, it is possible to provide a desensitizing solution for lithographic printing which has no pollution problems, shows high stability upon long-term storage, continuous use and environmental change, and enables a reduction in etch-processing time.

Further, when it is diluted with water, the desensitizing solution of the present invention can be used effectively as a dampening solution.

While the invention has been described in detail and with reference to specific embodiments thereof, it will be apparent to one skilled in the art that various changes and modifications can be made therein without departing from the spirit and scope thereof.

What is claimed is:

1. A desensitizing solution for lithographic printing, comprising at least one organometallic polymer containing at least two partial structure units represented by the following formula (1):

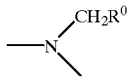

(1)

wherein $R^0$ represents $—PO_3H_2$, $—OPO_3H_2$ or a salt thereof.

2. The desensitizing solution as claimed in claim 1, wherein said organometallic polymer is a polymer prepared by hydrolytic polycondensation of at least one organometallic compound represented by the following formula (2):

$$(Q)_r M(Y)_{p-r} \quad (2)$$

wherein Q represents an organic residue having a partial structure unit represented by formula (1), Y represents a reactive group, M represents from trivalent to hexavalent metal, p represents a valence number of the metal M, and r represents 1, 2, 3 or 4, provided that p-r is 2 or more.

3. The desensitizing solution as claimed in claim 1, wherein the organometallic polymer is a copolymer comprising at least one unit selected from the group consisting of the units represented by the following formulae (3) to (8):

(3)

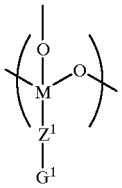

(4)

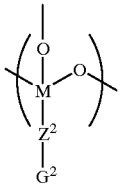

(5)

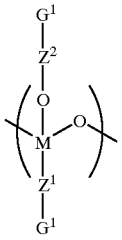

(6)

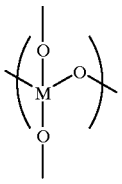

-continued (7)

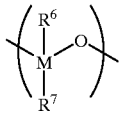

(8)

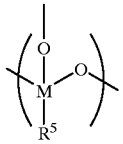

wherein $G^1$ represents $—N(R^1)CH_2R^0$ or $—N(CH_2R^0)_2$; $R^0$ has the same meaning as in formula (1); $G^2$ represents $—NR^2R^3$ or $—NR^2R^3R^{4+}X^-$; each of $R^1$ to $R^7$ represents a hydrogen atom or an unsubstituted or substituted organic residue, and they may combine each other to form a ring; $X^-$ represents a monovalent or higher valent anion; $Z^1$ and $Z^2$ which may be the same or different, each represent a divalent organic residue; and M has the same meaning as in formula (2).

4. The desensitizing solution as claimed in claim 1, wherein the organometallic polymer is a polymer constituted of organometallic polymers cross-linked between their main chains.

5. The desensitizing solution as claimed in claim 3, wherein the metal M in formulae (3) to (8) is Si.

6. The desensitizing solution as claimed in claim 1, wherein the organometallic polymer is a polymer represented by the following formula (9):

(9)

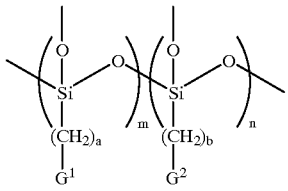

wherein $G^1$ and $G^2$ have the same meanings as $G^1$ and $G^2$ respectively in formulae (3) to (8); a and b each represent an integer of from 1 to 10; and m and n are values the total of which is 100 weight %.

* * * * *